US006362747B1

(12) United States Patent
Parker

(10) Patent No.: US 6,362,747 B1
(45) Date of Patent: Mar. 26, 2002

(54) SECURITY ALARM KEYPAD WITH MESSAGE ALERT

(75) Inventor: James Parker, Thornhill (CA)

(73) Assignee: Digital Security Controls Ltd., Concord (CA)

( * ) Notice: Subject to any disclaimer, the term of this patent is extended or adjusted under 35 U.S.C. 154(b) by 0 days.

(21) Appl. No.: 09/570,817

(22) Filed: May 15, 2000

(51) Int. Cl.[7] ..... G08B 3/00

(52) U.S. Cl. ..... 340/691.6; 340/5.2; 340/531; 340/545.1; 340/573.1

(58) Field of Search ..... 340/5.2, 528, 825.5, 340/531, 538, 541, 545.1, 573.1, 573.4, 691.6, 692; 379/37–40, 44, 48, 51

(56) References Cited

U.S. PATENT DOCUMENTS 5,754,111 A * 5/1998 Garcia ..... 340/573.1
5,757,616 A * 5/1998 May et al. ..... 361/683
6,067,018 A * 5/2000 Skelton et al. ..... 340/573.3
6,087,953 A * 7/2000 DeLine et al. ..... 340/815.4
6,147,598 A * 11/2000 Murphy et al. ..... 340/5.2 X

FOREIGN PATENT DOCUMENTS

GB 2299016 * 9/1996

* cited by examiner

*Primary Examiner*—Thomas Mullen

(57) ABSTRACT

A security alarm system is adapted to retrieve e-mail status information and provide an alert signal for the user of the system that e-mail has been received and is awaiting retrieval. Preferably, the keypad of the security system includes a visual indicator which is activated when e-mail is received. The security alarm system uses the control panel and the auto dialer associated therewith, to contact the e-mail server and receive status information of one or more e-mail accounts The control panel can contact the e-mail provider on a predetermined basis, or on a user scheduled basis. The accounting system's capability to initiate telephone communications and process signals from a remote computer is advantageously used for e-mail retrieval.

5 Claims, 4 Drawing Sheets

SECURITY ALARM KEYPAD WITH MESSAGE ALERT

BACKGROUND OF THE INVENTION

The present application relates to security alarm panels and in particular, relates to the security alarm system which includes an e-mail alert capability.

E-mail continues to increase in popularity, however, one of the major disadvantages associated with e-mail is that the mail recipient must retrieve the mail from their INTERNET Service Provider (ISP). Typically, the end user uses a computer to appropriately log on to the ISP provider and then receive status information regarding the e-mail account. This process is time consuming and also requires the end user to typically initiate the process.

The problem becomes more acute when the end user does not normally receive e-mail. Under these circumstances, he is less likely to check his mailbox on a regular basis, and as such, the e-mail is not timely delivered.

There have been arrangements for alerting the user that e-mail has been received, however, they have not proven particularly convenient and often require the user to purchase further services. As can be appreciated, if you are not using e-mail on a regular basis, it is even more difficult to justify an increase in cost associated with the receipt of this type of information.

The present invention seeks to overcome these disadvantages and an alternative approach for providing notice of the receipt of e-mail transmissions and optionally using e-mail as part of the reporting function of security alarm systems.

SUMMARY OF THE INVENTION

In a security alarm system according to the present invention the alarm system is provided with an e-mail transmission arrangement whereby the keypad of the security alarm system includes a visual display that provides a visual indication that e-mail has been received.

The security alarm system has a series of sensors which communicate with a control panel which determines alarm events and reports alarm events to a remote monitoring station. This report is completed using a telephone communication arrangement controlled by the control panel which initiates Contact with the remote monitoring station. The control panel also includes a keypad display used for entering security codes used to arm and disarm the system and provides a visual display of the state of the alarm system and sensors. The alarm system includes a telephone communication arrangement which is used by the control panel for contacting the remote monitoring station. The control panel stores a first telephone address for communicating with the remote monitoring station and stores a second telephone address for communicating with a computer for receiving e-mail status information in respect of a predetermined account. The control panel initiates contact with the computer on a predetermined basis. During contact with the computer, the control panel receives the status information of the e-mail account including whether e-mail has been received. The control panel produces a visual indication on the keyboard or audible alert when the information indicates that an e-mail has been received and not yet retrieved by the user.

With the above arrangement, the user interacting with the keyboard is alerted by a visual or audible indication that e-mail has been received and should be retrieved. In a preferred embodiment of the invention, the visual display includes the capability of displaying several lines of information such that summary information with respect to the e-mail is displayed.

The control panel 4 includes as part thereof, a telephone dialer 14 as well as control logic 15 for determining what particular functions are to be carried out.

According to a further aspect of the invention, the control panel initiates contact with the e-mail computer after the security alarm system has been disarmed.

According to yet a further aspect of the invention, the control panel contacts the e-mail computer and seeks information with respect to an e-mail account associated with a particular security code used to disarm the system. In this way, e-mail information specific to the user who disarmed the system is obtained. The control panel has a series of telephone numbers for contacting different e-mail accounts.

In a further aspect of the invention, the control panel produces a sound alert that- e-mail is awaiting retrieval.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
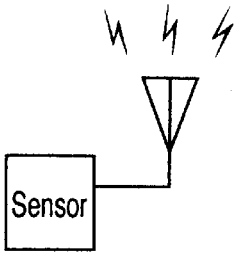
FIG. 1 is a schematic of a security alarm system.
Figure 1:
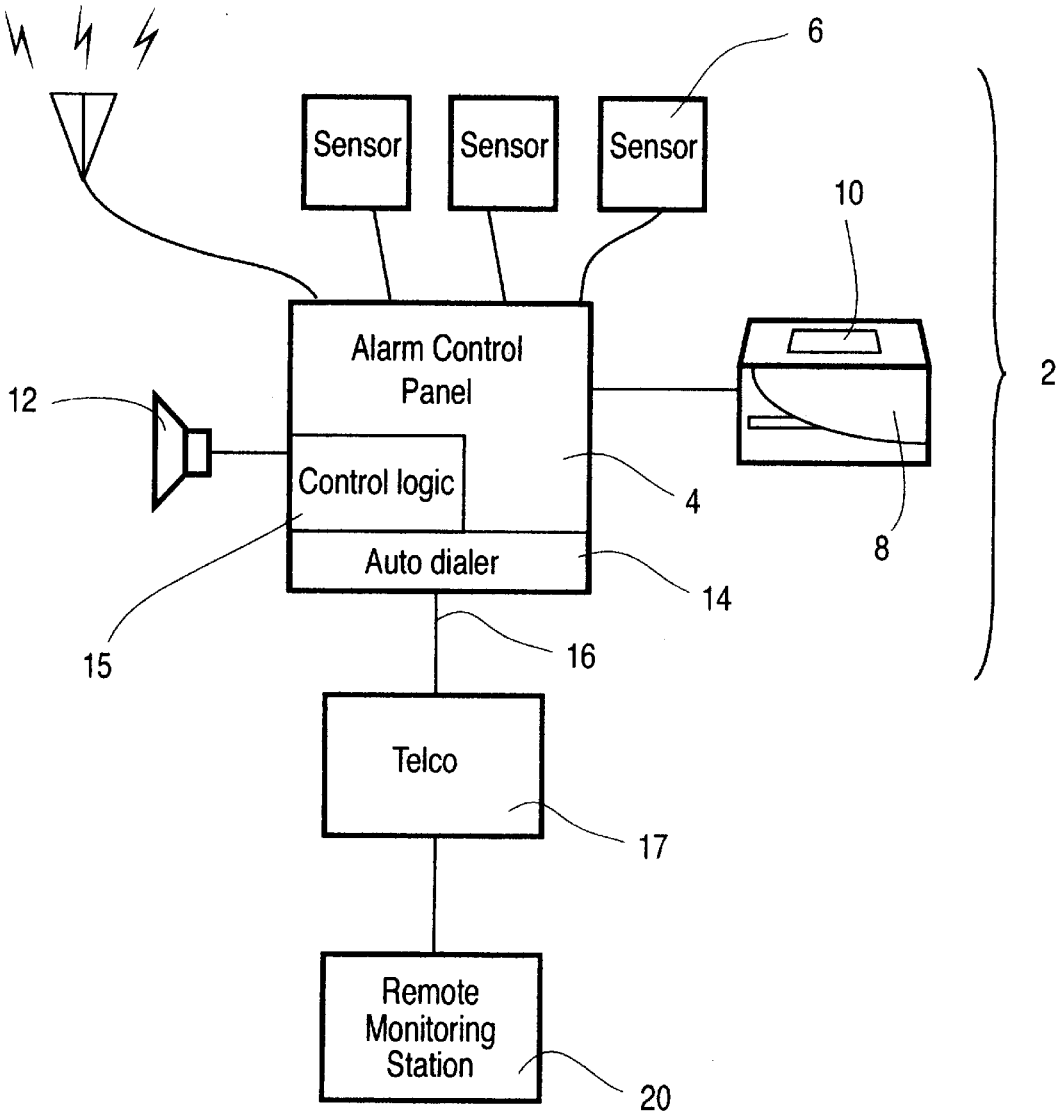

The security system 2 includes an alarm control panel 4 which receives the signals from a host of different sensors 6. These sensors 6 can be hard wired to the alarm control panel 4 or can communicate with the alarm control panel 4 using RF transmission signals. A keypad 8 allows a user to interact with the system to determine the status thereof and arm or disarm or effect changes to the system. A sounder 12 is controlled by the. control panel 4.

The control panel 4 includes as part thereof, a telephone dialer 14 as well as control logic 15 for determining what particular functions are to be carried out.

The security system 2 from time to time connects a telephone communication 16 with the remote monitoring station 20 via the Telco 17. Typically, the alarm control panel 4 uses this communication to report an alarm event or to complete a daily or predetermined check in with the remote monitoring station.

Figure 2:
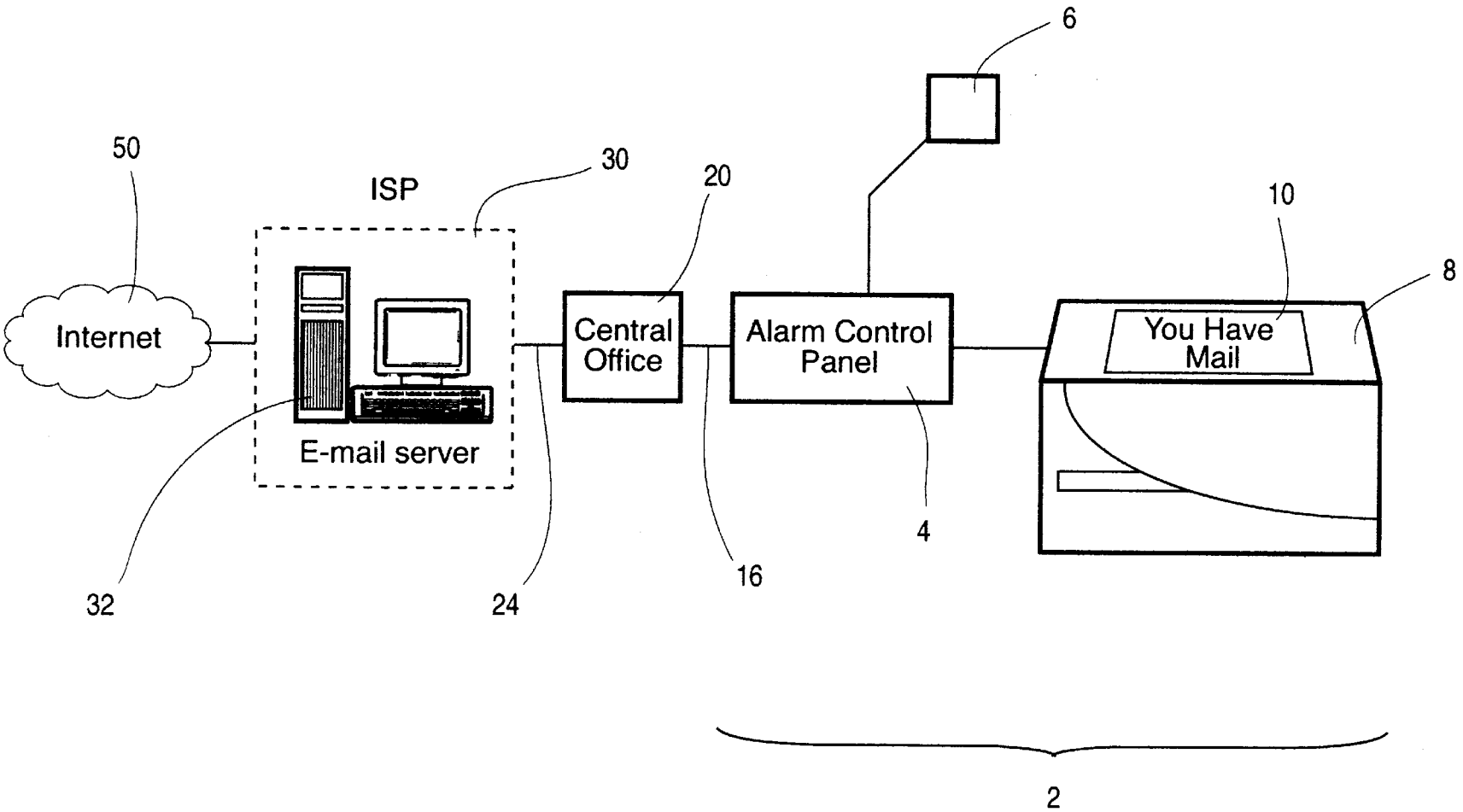
FIG. 2 is a schematic showing integration of a security alarm system with an e-mail server.

FIG. 2 shows the security system 2 in cooperation with the remote monitoring station 20 which is connected to the ISP 30 having the e-mail server 32. The remote monitoring station 20 and the ISP 30 are capable of communication as indicated by connection 24. This could be a telephone line connection, a cable connection, or any other suitable connection. Preferably, this is a high speed connection. The e-mail server is connected to the INTERNET 50 and again, this connection is typically a high speed connection.

The alarm control panel 4 when in an armed state, awaits an event such as the opening of a door which either results in an alarm or an event being reported, or the system being appropriately disarmed. The system is disarmed in the traditional manner by the user entering the premise and entering a security code. Upon a successful entry of the security code, the alarm control panel 4 is essentially in a stand by state and is free to carry out other functions. In particular, the alarm control panel 4 is effectively disarmed and therefore the control processor and the auto dialer are originally idle. The alarm control panel 4 is programmed to identify an e-mail account associated with the security code and in other e-mail accounts which are to be checked. The auto dialer is used to contact the appropriate e-mail computer and the information necessary for gaining e-mail status access is provided thereto. The e-mail computer then provides e-mail summary information to the alarm control panel 4. The alarm control panel 4 produces a visual indication such as the message shown on the display 10 to alert the user that e-mail is awaiting retrieval. The precise form of the summary information can be varied from a simple indication that e-mail has been received to more complete information including details of the received e-mail. Typically, the keypad 8 has a display which allows several lines of code to be displayed.

The keypad 8 can also include specialized programmed keys which can be programmed for retrieval of e-mail information upon execution. In this way, the user can retrieve e-mail status information upon demand.

The alarm control panel 4 is not limited to contacting the e-mail server 32 only when the system is disarmed. For example, the -alarm control panel 4 could contact the e-mail server 32 on a predetermined time schedule or at times or events to be determined by the user. For example, the alarm control panel 4 can be monitoring the telephone line and it could contact the e-mail server on a certain basis when the system is armed. As can be appreciated, the phone should not be in use as no one is home. The control panel 4 can obviously stop any contact with the e-mail server if an alarm event occurs or use this connection to report an alarm event to the remote monitoring station. The alarm control panel 4 does include circuitry for seizing of the line from other telephone services and reports alarm events on a priority basis.

FIG. 2 also allows communication between the e-mail server and the remote monitoring station 20. The e-mail server could be providing e-mail status information for the various alarm systems on an ongoing basis. In this way, the information would be available to the remote monitoring station and whenever contact is made, the e-mail information is updated. If the keypad 8 has additional display capability, more sophisticated e-mail information can be provided to it. In most cases, it is desirable to have the alarm control panel complete a separate telephone communication to the e-mail server 32 thus leaving the remote monitoring station free to carry out its function.

Figure 3:
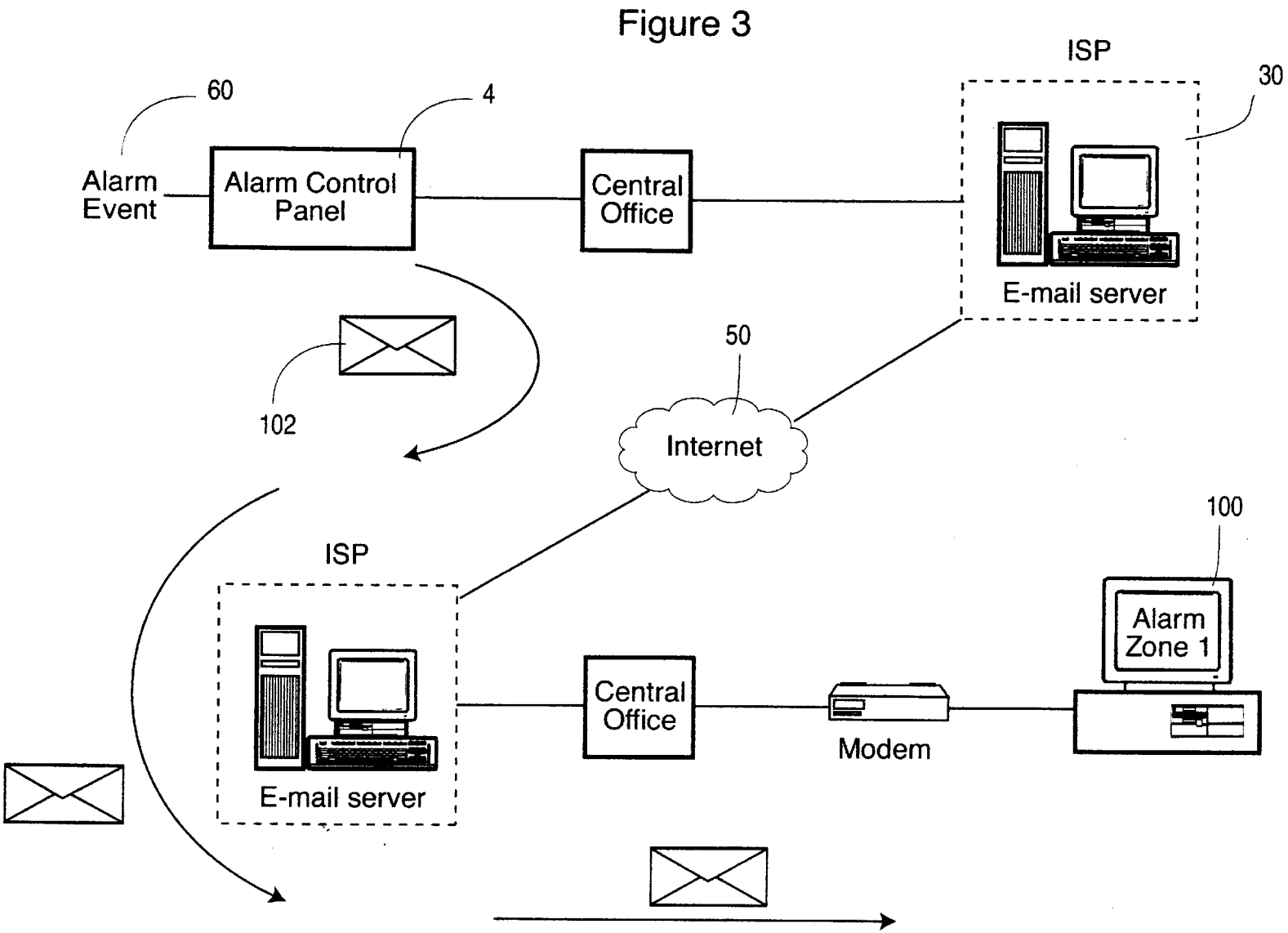
FIG. 3 is a schematic illustrating e-mail communication being initiated by the security alarm system to a predetermined source previously identified by the user.

The embodiment of FIG. 3 is useful for outputting additional information from the alarm control panel 4 forward to an additional remote computer. The alarm control panel 4 functions in its normal manner to report the alarm event 60 to the remote monitoring station 20. The various security functions continue to function in the normal manner and the remote monitoring station will authorize the appropriate medical or security response. After the alarm control panel 4 has completed this function, it additionally reports this alarm or medical event to the computer shown as 100. This remote computer could be the user's computer at work, or the user's paging service. The alarm control panel 4 uses the auto dialer to effect a communication with the e-mail server 30. The e-mail server 30 receives a signal from the alarm control panel 4 which identifies a particular e-mail address to be used. This can be prearranged with the e-mail server 30 or it can be maintained in the alarm control panel 4. In any event, an e-mail transmission indicated as 102 is sent from the alarm control panel 4 to the computer 100. The e-mail server 30 forwards this to the additional computer 100. The e-mail will provide the user with details of the alarm event and the particular sensor which has triggered the alarm event.

As can be further appreciated, the alarm control panel 4 can report not only to the monitor station 20 but to a particular e-mail server 32. A user who is away from the premise can contact the e-mail server 32 and receive a report regarding the activity of the security alarm control system. Therefore, in addition to reporting to the remote monitoring station 20, the alarm control panel can report directly to a separate e-mail server 32 or can have the remote monitoring station 20 provide a report to that e-mail server. In this way, better access as to the status of the system can be made and it may be a more cost effective approach, particularly if the user is travelling and any telephone communication would result in long distance charges. The e-mail server can forward the reports according to instructions received from the user.

From the above, it can be seen that the alarm system will notify the user of arrival of new e-mail. This may merely be an LED being lit on the keypad 8 or it may be a separate message provided on the message display of the keypad. The main purpose is to provide an indication that an e-mail has been received to encourage the user to retrieve this e-mail at the earliest convenience. A control panel of the security system, given that there is a visual display, may provide an indication that new mail has been received and provide details thereof such as displaying the number of new messages, subject, sender, time/date received, etc.

The alarm control panel 4 is programmed with information to initiate contact with the e-mail server. This information typically includes the e-mail account, the phone number of the e-mail server, login name, password, account information, communication protocols, etc.

The alarm control panel 4 may be programmed to allow access of multiple e-mail accounts. These e-mail accounts can be associated with particular security codes if this is desired. The alarm control panel 4 may also allow alarm events to be reported to a remote location via e-mail. It can further be appreciated that if the alarm control panel 4 communicates with the e-mail server via a cable connection, for example, this e-mail communication could provide the back up communication path for communicating with a remote monitoring station, For example, the control panel could normally report this directly using the telephone communication path, however, it this fails, and there is a cable connection allowing e-mail, then the control panel could report to the remote monitoring station using this alternate path.

Figure 4:
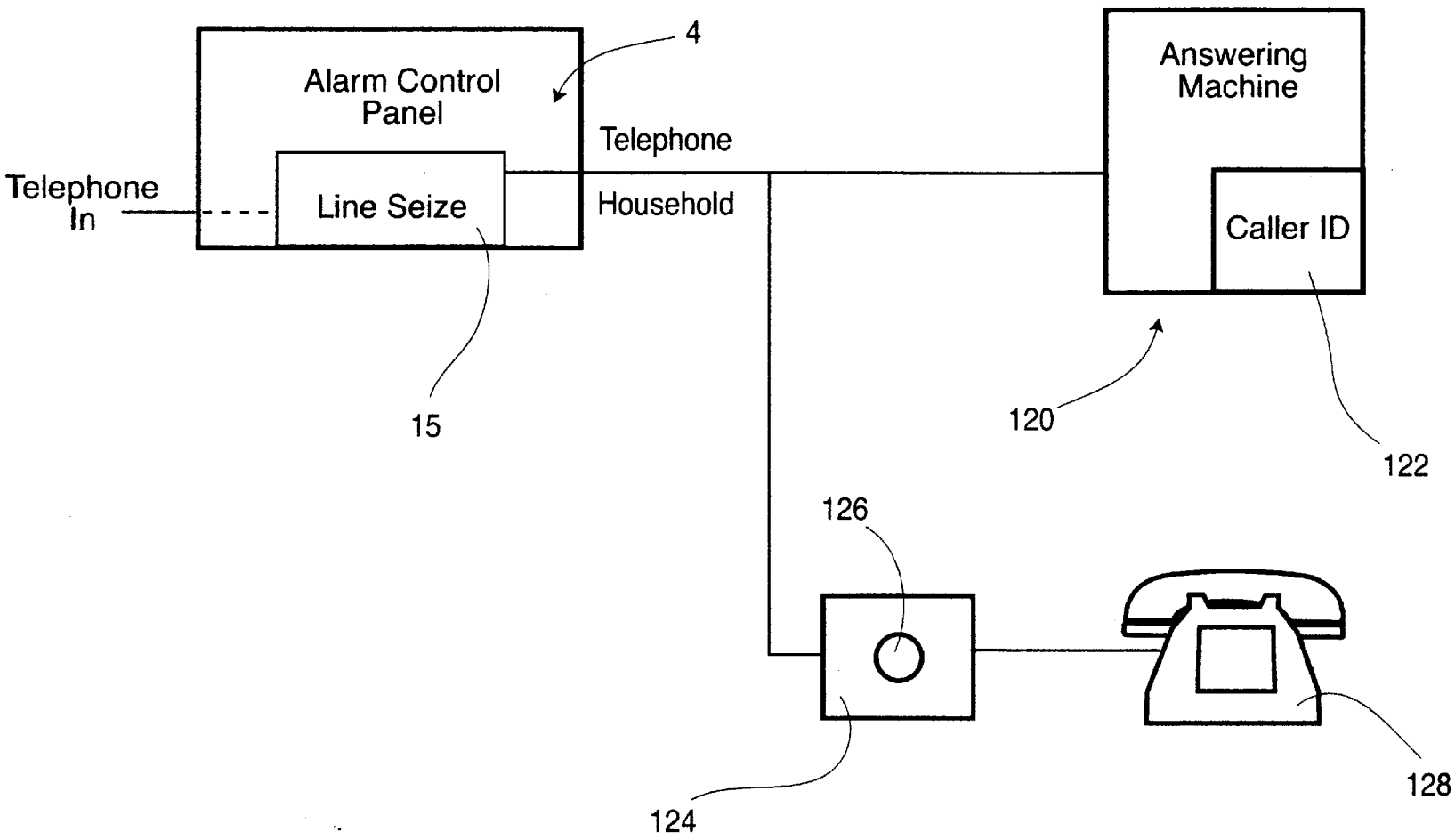
FIG. 4 is a schematic of an alternate arrangement integrating e-mail with the security system.

An alternate embodiment is shown in FIG. 4 which allows the control panel 4 to report pending e-mail to an answering machine 120. The control panel 4, upon determining e-mail has been received, uses the line seize circuitry 15 to isolate the in house system from the external telephone system. The answer machine 120 preferably has caller ID capability 122. The control panel 4 mimics the telephone system and provides a ring signal to the household system. The digital answering machine picks up and receives a caller ID signal "E-MAIL" provided by the control panel 4. In this way, the caller ID is provided to the answering machine and recorded.

It is also possible for the control panel to leave a voice message "You have mail". Each control panel could include circuitry for producing this audible message which is then recorded. It is also possible to have the e-mail server provide this message when reporting to the control panel. The control panel falsely causes the answering machine to pick up, and then connects to the e-mail server which is waiting on the line and full details of the pending e-mail are audibly provided by the e-mail server and recorded by the answering machine.

In yet a further embodiment, the. control panel provides a signal on the telephone line indicating e-mail has been received. A separate device 124 on the telephone system turns on an activating LED 126 indicating e-mail has been received. This device can be positioned in front of a conventional phone 128 and can be powered by the telephone system.

The control panel 4 can be programmed by the user with respect to a schedule for checking e-mail. For example, e-mail could be checked each morning prior to anticipated departure. When the user arms the system, the status of the e-mail account is provided. This scheduling also allows for retrieval based on anticipated returns.

It is also possible for the remote monitoring station to send e-mail to the user regarding testing or status of the system.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. In a security alarm system having a series of sensors in communication with a control panel which determines alarm events and reports the alarm events to a remote monitoring station by initiating a telephone communication with said remote monitoring station, said control panel including a keypad display used for entering security codes used to arm and disarm the system and provide visual display of the state of the alarm system and sensors, said alarm system including a telephone communication arrangement, said control panel having in storage a first telephone address for communicating with said remote monitoring station using said telephone communication arrangement and a second telephone address for communication with a computer for recovery of e-mail information from a predetermined account, said control panel initiating contact with said computer on a predetermined basis, said control panel during contact with said computer receiving information of the status of the e-mail account including whether e-mail has been received, said control. panel when informed e-mail has been received producing a visual indication on said keyboard that e-mail has been received.

2. In a security system as claimed in claim 1 wherein said visual indication is a light emitting source on said keypad.

3. In a security system as claimed in claim 1 wherein said visual indication is a message shown on a visual display of said keypad.

4. In a security system as claimed in claim 1 wherein said predetermined basis for initiating contact with said computer is based on when the security system has been disarmed.

5. In a security system as claimed in claim 1 wherein said control panel retrieves information with respect to several email accounts and each e-mail account is associated with a security code of said security system, said predetermined basis for initiating contact with said computer is based on the security code used to disarm the system and retrieves email information of the account associated with the particular security code.

* * * * *